US005113480A

United States Patent [19]

Murphy et al.

[11] Patent Number: 5,113,480

[45] Date of Patent: May 12, 1992

[54] FLUID HEATER UTILIZING DUAL HEATING ELEMENTS INTERCONNECTED WITH CONDUCTIVE JUMPER

[75] Inventors: Robert A. Murphy; Rodney R. Syler, both of Franklin; William H. Slattery, Spring Hill, all of Tenn.

[73] Assignee: Apcom, Inc., Franklin, Tenn.

[21] Appl. No.: 534,815

[22] Filed: Jun. 7, 1990

[51] Int. Cl.[5] ..... H05B 3/82; H01R 31/08; F24H 9/12

[52] U.S. Cl. ..... 392/501; 392/500; 392/455; 219/537; 219/541; 338/295

[58] Field of Search ..... 392/501, 500, 451, 449, 392/453, 455; 219/541, 537, 539, 542, 520; 439/507, 513; 338/295; 174/268

[56] References Cited

U.S. PATENT DOCUMENTS

| | | | |
|---|---|---|---|
| D. 224,406 | 7/1972 | Heck | 439/513 |
| 1,046,465 | 12/1912 | Hoyt | 439/507 |
| 1,281,157 | 10/1918 | Hadaway, Jr. | 392/500 |
| 2,274,445 | 2/1942 | Greer | 392/501 |
| 3,496,517 | 2/1970 | Walter | 439/513 |
| 3,831,129 | 8/1974 | Frey | 439/507 |
| 4,217,483 | 8/1980 | Vogel et al. | 392/500 |

OTHER PUBLICATIONS

Western Electric Technical Digest No. 60, p. 25, Oct. 1980.

*Primary Examiner*—Bruce A. Reynolds
*Assistant Examiner*—John A. Jeffery
*Attorney, Agent, or Firm*—Paul R. Puerner

[57] ABSTRACT

A dual element comprises two electrical heating elements of different ratings. Each heating element has first and second terminals. The second terminals of the two heating elements are secured to a common clip, which is wired into an appropriate electrical circuit. The heating element first terminals are secured to respective clips. A second wire of the circuit is connected to a selected one of the first terminal clips, thereby determining the power rating of the dual element. A jumper is provided that is selectively installable between the two first terminal clips. With the jumper installed, the second wire may be connected to either of the first terminal clips to thereby place the two heating elements in parallel. The rating of the dual element is then the sum of the ratings of the two individual heating elements. In that manner, the dual element is operable at three different ratings.

7 Claims, 1 Drawing Sheet

Fig. 1
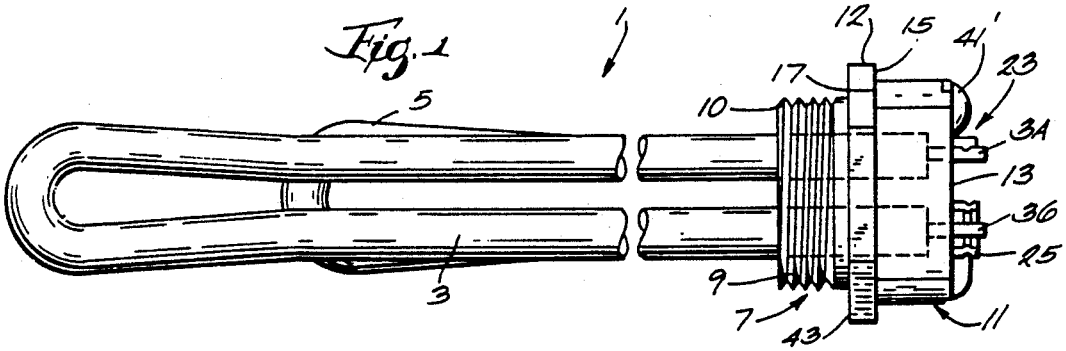
Fig. 2
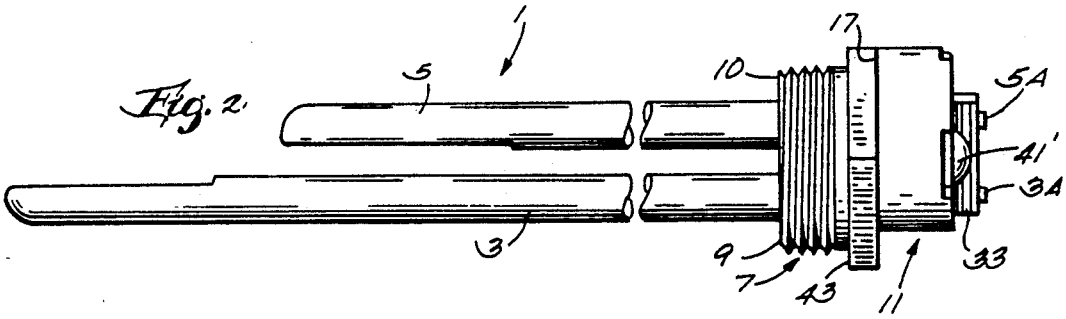
Fig. 3
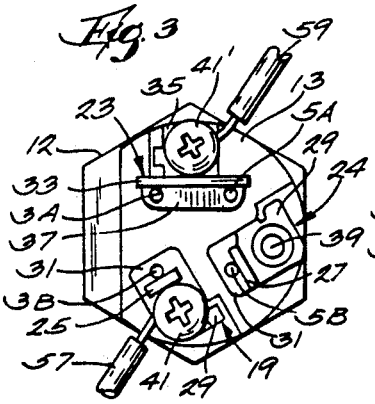
Fig. 4
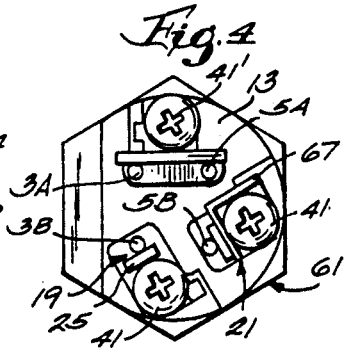
Fig. 5
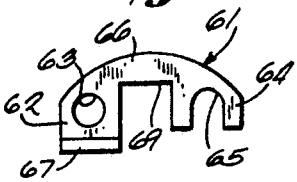
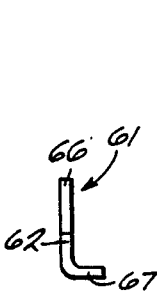
Fig. 6
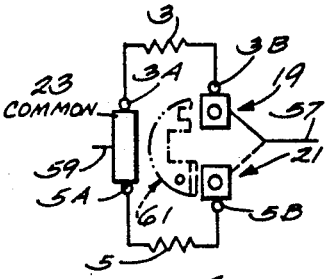
Fig. 8
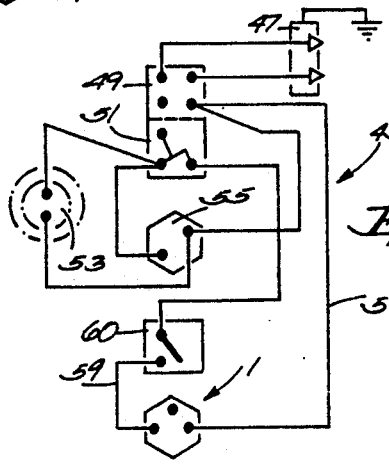
Fig. 7

FLUID HEATER UTILIZING DUAL HEATING ELEMENTS INTERCONNECTED WITH CONDUCTIVE JUMPER

BACKGROUND OF THE INVENTION

1. Field of the Invention

This invention pertains to electric heating, and more particularly to variable capacity electric resistance heating.

2. Description of the Prior Art

It is a common practice to use electrical energy for heating purposes. A properly designed resistor placed in an electric circuit becomes heated upon energizing the circuit, and the resistor heats the surrounding environment.

Heating water is a common application of electric resistance heating. A resistor, often referred to as a heating element, is immersed in water stored in a vessel. Applying a voltage across the element terminals causes the temperature of the element to rise, thus heating the water. Heating elements having different ratings are often interchangeable within a water heater or other appliance. In that manner, water heaters having different capacities can be supplied merely by replacing a heating element of one rating with a heating element of another rating.

However, interchanging heating elements to obtain different capacity heaters has certain drawbacks. One drawback is that manufactures and dealers must make and stock different components corresponding to the different rating heating elements. It is well known, of course, that producing relatively few of several different parts and carrying those parts in inventory is undersirably expensive. In addition, changing heating elements requires care in handling the necessary tools and in assuring waterproof connections.

Thus, a need exists for improvements in electric heating elements.

SUMMARY OF THE INVENTION

In accordance with the present invention, an electrical dual element is provided that enables quick and easy conversion of the dual element between three different ratings. This is accomplished by apparatus that includes two heating elements of different ratings assembled to a common flange and selectively wireable into an electric circuit.

The two heating elements may be generally U-shaped, having respective input and output terminals. The output terminals are secured to a common clip. Each of the heating element input terminals is secured to a separate clip. The clips associated with the input terminals of the two heating elements are selectively connectable to a first wire that forms a part of the electrical circuit. A second wire leads from the common clip to the electrical circuit. If the first wire is connected to the clip associated with the input terminal of the first heating element, the first heating element is in the circuit to produce a first capacity to the dual element, and the second heating element is not in the circuit. If the first wire is connected to the clip associated with the second heating element, the second heating element is in the circuit to produce a second capacity to the dual element, and the first heating element is out of the circuit.

Further in accordance with the present invention, the dual element is capable of operating at a third capacity.

For that purpose, the present invention includes a jumper that is selectively installable between the clips of the input terminals of the two heating elements. By installing the jumper and connecting the electrical circuit first wire to the input terminal clip of either the first or second heating elements, the two heating elements are placed in parallel in the circuit. The dual element thus acquires a third rating that is equal to the sum of the ratings of the two individual heating elements. Consequently, a single dual element and simple jumper are the only components that need be manufactured and inventoried to produce the triple-rating dual element.

Other advantages, benefits, and features of the invention will become apparent to those skilled in the art upon reading the detailed description of the invention.

BRIEF DESCRIPTION OF THE DRAWINGS

FIG. 1 is a front view of the dual element of the present invention.

FIG. 2 is a top view of the dual element of the present invention.

FIG. 3 is an end view of the dual element showing an electric circuit arrangement for single rating operation of the dual element.

FIG. 4 is a view similar to FIG. 3, but showing a jumper in place for multiple rating operation of the dual element.

FIG. 5 is a top view of the jumper according to the present invention.

FIG. 6 is an end view of FIG. 5.

FIG. 7 is a schematic drawing of the dual element wired in a typical electric circuit.

FIG. 8 is a schematic view of a portion of the circuit of FIG. 7 detailing the electrical connections of the dual heating element.

DETAILED DESCRIPTION OF THE INVENTION

Referring to FIGS. 1–3, a dual element 1 is illustrated that includes the present invention. The dual element is particularly useful for controlling the temperature of a fluid inside a vessel. For example, the dual element may be used in connection with a hot water heater, but it will be understood that the invention is not limited to water heating applications.

The dual element 1 is comprised of a first heating element 3 and a second heating element 5. Both heating elements 3 and 5 are generally U-shaped, and each has two free ends. The free ends of the first heating element terminate in respective small diameter terminals 3A and 3B. Similarly, the free ends of the second heating element 5 terminate in respective terminals 5A and 5B.

The free ends fo the heating elements 3 and 5 are received in appropriate holes in a flange 7. The flange 7 may be made from a metallic material, such as steel. The connections between the two heating elements and the flange are leak-proof. Preferably, the heating elements are staked to the flange without the use of forming buttons on the flange underside 9. In the illustrated construction, the flange is fabricated with male threads 10 and a hex periphery 12 so as to enable the flange to be assembled to a water tank, not shown.

The dual element 1 further comprises a block 11 that preferably is made of a tough thermosetting plastic material such as polypropylene. The block 11 has an exposed first face 13 and a generally parallel second face 17. The second face 17 is placed against the top surface 15 of the flange 7. The block has holes for receiving the free ends of the heating elements 3 and 5, including relatively small diameter holes for the terminals 3A, 3B, 5A, and 5B.

To retain the heating elements 3 and 5, flange 7, and block 11 together as a unitary assembly, the dual element 1 employs three clips 19, 21, and 23. The clips 19 and 21 may be identical. The clips 19 and 21 have respective upturned legs 25 and 27 that are welded to the terminals 3A and 5A on the heating elements 3 and 5, respectively. Each clip 19 and 21 also has a base portion 29 that lies against the block face 13, and an ear that extends into an appropriate slot in the block. If desired, the block face 13 may be formed with shallow pockets 31 for receiving the clips. Similarly, the clip 23 has an upturned leg 33 to which is welded the terminals 3A and 5A of the heating elements 3 and 5, respectively. The clip 23 is thus common to both heating elements. The clip 23 has a base portion 35 that lies against the block face 13; if desired, the clip base portion 35 may fit into a pocket 37 in the block face 13. Each of the clips 19 and 21 has a tapped hole 39 for receiving a pan head cap screw 41. The common clip 23 has a similar tapped hole for a screw 41'.

In operation, the dual element 1 is assembled to a vessel, such as a water heater tank, by means of the threads 10 and the hex periphery 12. The underside 43 of the flange hex seats against a cooperating surface on the vessel to form a leak-proof joint. The dual element is wired into an electric circuit, such as a circuit 45 depicted in FIG. 7. In circuit 45, reference numeral 47 indicates a junction box that connects to a power supply. The circuit may include a high-temperature limit switch 49, a thermostat 51, an indicator light 53, and an upper heating element 55. A thermostat 60 may be associated with the dual element 1. It will be appreciated, of course, that the dual element can be used in conjunction with numerous other electrical circuits.

The dual element 1 is wired into the circuit 45 by a first wire 57 and a second wire 59. The first wire 57 may be connected to the dual element 1 by either the clip 19 associated with heating element 3 or by the clip 21 associated with the heating element 5. In either case, the exposed conductor of the wire 57 is retained under the head of the associated screw 41. The second wire 59 is retained under the head of the screw 41' threaded into the common clip 23 associated with the terminals 3A and 5A of the two heating elements. By selecting the clip 19 or 21 to which the first wire 57 is connected, the dual element 1 operates at the rating of the first or the second heating elements, respectively. For example, the first heating element 3 may have a rating of 3800 watts; the second heating element 5 may have a rating of 1700 watts, so the dual element has selective first and second capacities of 3800 or 1700 watts.

Further in accordance with the present invention, the dual element 1 is capable of operating at a rating that is the sum of the first and second ratings. Looking also at FIGS. 4-6, operation at the third rating is achieved by connecting the first and second heating elements 3 and 5, respectively, in parallel with each other in the circuit 45 by means of a jumper 61. In the preferred embodiment, the jumper 61 is manufactured as a thin piece metallic material. The particular jumper 61 illustrated has a generally U-shape with a pair of legs 62 and 64 joined by a center portion 66. The leg 62 of the jumper defines a hole 63. The other jumper leg 64 defines an open slot 65. The free end of the leg 62 terminates in an upwardly turned tab 67. The distance between the center lines of the hole 63 and the slot 65 is equal to the distance between the tapped holes 39 of the two clips 19 and 21 of the dual element. The jumper center portion 66 preferably cooperates with the legs to define a straight-sided cut-out 69.

The jumper 61 is designed such that the first leg 62 thereof is placeable over and contactable with the dual element clip 19, and the jumper second leg 64 is placeable over and contactable with the dual element clip 21. In that situation, the jumper hole 63 and slot 65 are aligned with the holes in the respective clips 19 and 21. A screw 41 is threaded into each clip hole 39, thereby electrically joining the heater element terminals 3B and 5B.

The wire 57 may be connected to the screw 41 associated with either of the clips 19 or 21. The wire 59 remains connected to the screw 41' associated with the common clip 23. With the terminals 3A and 5A electrically connected with each other in the circuit 45 by the common clip 23, the two heating elements 3 and 5 are in parallel with each other in the circuit. When the circuit is energized, the rating of the dual element 1 is the sum of the ratings of the two individual heating elements 3 and 5. Thus, with heating elements 3 and 5 having ratings of 3800 and 1700 watts, respectively, the rating of the dual element is 5500 watts with the jumper 61 in place. In that manner, manufacturers and dealers are able to supply their customers with water heaters and other appliances having three different capacities built into a single product. As a result, manufacturing, inventory, and heating conversion costs are greatly reduced.

We claim:

1. A dual element comprising:

a. a first generally U-shaped heating element having first and second free ends;

b. a second generally U-shaped heating element having first and second free ends;

c. flange means for fixedly receiving the first and second heating elements generally near the respective free ends thereof;

d. a first generally L-shaped clip having a base portion that lies against the flange means and an upturned leg, the first clip upturned leg being secured to the first free end of the first heating element;

e. a second generally L-shaped clip having a base portion that lies against the flange means and an upturned leg, the second clip upturned leg being secured to the first free end of the second heating element, the base portion of the second clip being generally coplanar with the base portion of the first clip;

f. a common generally L-shaped clip having a base portion that lies against the flange means and an upturned leg, the common clip upturned leg being secured to the second free ends of the first and second heating elements; and g. jumper means for selectively providing electrical contact between the first and second clips, so that the first and second heating elements are selectively connectable with each other in an electrical circuit.

2. The dual element of claim 1 wherein the jumper means is formed as a generally U-shaped piece of conductive material having first and second coplanar legs that overlie and contact the base portions of the first and second clips, respectively, to thereby provide electrical contact therebetween.

3. The dual element of claim 2 wherein the jumper means defines a cut-out between the first and second legs thereof that provides clearance with the upturned leg of at least one of the first and second clips when the jumper means provides electrical connection between the first and second clips.

4. In combination with a vessel containing a fluid, a dual element useful for controlling the temperature of the fluid comprising:

a. flange means for removably assembling to the vessel;

b. first and second heating elements received in the flange means and in contact with the fluid in the vessel, each heating element having respective first and second terminals that extend outside of the flange means;

c. first and second clip means secured to the first terminals of the respective first and second heating elements;

d. third clip means secured to the second terminals of the first and second heating elements;

e. an electrically insulative block interposed between the first, second, and third clip means and the flange means, the block defining holes through which the terminals of the first and second heating elements pass; and f. jumper means for selectively installing between the first and second clip means to electrically connect the first terminals of the first and second heating elements to each other.

5. In combination with a vessel containing a fluid, a dual element useful for controlling the temperature of the fluid comprising:

a. flange means for removably assembling to the vessel;

b. first and second heating elements received in the flange means and in contact with the fluid in the vessel, each heating element having respective first and second terminals that extend outside of the flange means;

c. first and second clip means secured to the first terminals of the respective first and second heating elements;

d. third clip means secured to the second terminals of the first and second heating elements, wherein:

each of the first, second, and third clip means comprises a clip having a base portion lying in contact with the block and an upturned leg that is secured to the respective heating element terminal; and a screw threadable into the clip base portion;

e. a block interposed between the first, second, and third clip means and the flange means, the block defining holes through which the terminals of the first and second heating elements pass; and f. jumper means for selectively installing between the first and second clip means to electrically connect the first terminals of the first and second heating elements to each other, wherein the jumper means defines first and second openings therethrough for receiving the screws of the first and second clips when the jumper means is installed therebetween.

6. The combination of claim 5, wherein the jumper means comprises a generally U-shaped piece of conductive material having first and second legs that define respective first and second openings, the jumper means piece of material further defining a cut-out that provides clearance with a selected one of the first and second clips when the jumper means is installed therebetween.

7. The combination of claim 6 wherein the jumper means first and second legs overly and are in facing contact with the base portions of the respective first and second clips when the jumper means is installed therebetween.

* * * * *